US008547020B2

(12) United States Patent
Barroso et al.

(10) Patent No.: US 8,547,020 B2
(45) Date of Patent: Oct. 1, 2013

(54) CONTROL OF A PLURALITY OF PLUG COILS VIA A SINGLE POWER STAGE

(75) Inventors: Paulo Barroso, Les Mureaux (FR); Clement Nouvel, Verneuil sur Seine (FR); Nabil Meziti, Argenteuil (FR)

(73) Assignee: Renault S.A.S., Boulogne-Billancourt (FR)

( * ) Notice: Subject to any disclaimer, the term of this patent is extended or adjusted under 35 U.S.C. 154(b) by 492 days.

(21) Appl. No.: 12/529,417

(22) PCT Filed: Feb. 25, 2008

(86) PCT No.: PCT/FR2008/050310

§ 371 (c)(1),
(2), (4) Date: Apr. 6, 2010

(87) PCT Pub. No.: WO2008/113955

PCT Pub. Date: Sep. 25, 2008

(65) Prior Publication Data

US 2010/0194279 A1 Aug. 5, 2010

(30) Foreign Application Priority Data

Mar. 1, 2007 (FR) ..... 07 01499

(51) Int. Cl.
*H01J 7/24* (2006.01)

(52) U.S. Cl.
USPC ..... 315/111.21; 315/247; 315/291; 315/274; 315/209 R

(58) Field of Classification Search
USPC ..... 315/111.21, 274–279, 247, 291, 315/307–326; 123/604, 606, 594, 643
See application file for complete search history.

(56) References Cited

U.S. PATENT DOCUMENTS

| | | | | |
|---|---|---|---|---|
| 4,317,068 | A * | 2/1982 | Ward et al. | 315/209 CD |
| 4,510,915 | A * | 4/1985 | Ishikawa et al. | 123/620 |
| 4,739,185 | A * | 4/1988 | Lee et al. | 307/106 |
| 5,587,630 | A | 12/1996 | Dooley | |
| 5,655,210 | A * | 8/1997 | Gregoire et al. | 422/186 |
| 7,663,555 | B2 * | 2/2010 | Caimi et al. | 343/702 |
| 8,104,444 | B2 * | 1/2012 | Schultz | 123/143 B |
| 2007/0188260 | A1 * | 8/2007 | Kawai | 333/32 |
| 2010/0251995 | A1 * | 10/2010 | Nouvel et al. | 123/406.19 |
| 2010/0313841 | A1 * | 12/2010 | Agneray et al. | 123/169 R |

FOREIGN PATENT DOCUMENTS

| | | |
|---|---|---|
| DE | 10 2005 036 968 | 2/2007 |
| FR | 2 859 869 | 3/2005 |

OTHER PUBLICATIONS

U.S. Appl. No. 13/057,349, filed Feb. 3, 2011, Agneray et al.

* cited by examiner

*Primary Examiner* — Tuyet Thi Vo
(74) *Attorney, Agent, or Firm* — Oblon, Spivak, McClelland, Maier & Neustadt, L.L.P.

(57) ABSTRACT

A radiofrequency plasma generating device including: a supply circuit including a switch controlled by a control signal for applying a voltage on an output of the control circuit at a control frequency; at least two plasma-generating circuits connected in parallel at the output of the supply circuits, each circuit having its own resonance frequency and being capable of generating plasma when a high voltage level is applied to the output of the supply circuit at a frequency substantially equal to the resonance frequency of the plasma generation circuit; and a supply control device determining the control frequency from the resonance frequencies of the plasma generation circuits to selectively control each circuit according to the control frequency used.

10 Claims, 3 Drawing Sheets

CONTROL OF A PLURALITY OF PLUG COILS VIA A SINGLE POWER STAGE

The present invention relates generally to the plasma generation systems between two electrodes of a plug, used in particular for the controlled radio frequency ignition of a gaseous mixture in the combustion chambers of an internal combustion engine.

For such an application to plasma-generated motor vehicle ignition, plasma generation circuits incorporating plug coils are used to generate multiple-filament discharges between their electrodes, making it possible to initiate the combustion of the mixture in the combustion chambers of the engine. The multi-spark plug is described in detail in the following patent applications in the name of the applicant: FR 03-10766, FR 03-10767 and FR 03-10768.

Such a plug coil is conventionally modeled by a resonator 1, the resonance frequency $F_c$ of which is greater than 1 MHz, typically adjacent to 5 MHz. The resonator comprises, in series, a resistance R, an inductance L and a capacitance C. Ignition electrodes 10 and 12 of the plug coil are connected to the terminals of the capacitance C.

When the resonator is powered by a high voltage at its resonance frequency $f_c$ $(1/(2\pi\sqrt{L*C}))$, the amplitude at the terminals of the capacitance C is amplified, making it possible to develop multiple-filament discharges between the electrodes of the plug, over distances of the order of a centimeter, at high pressure and for peak voltages less than 30 kV.

The term "branched sparks" then applies, in as much as they involve the simultaneous generation of at least several ionization lines or paths in a given volume, their branch lines also being omnidirectional.

Controlling the power supply of such a plug coil requires the use of a power supply circuit, capable of generating voltage pulses, typically with a rise time of 100 ns and with an amplitude of the order of 1 kV, at a frequency designed to be very close to the resonance frequency of the radio frequency resonator of the plug coil. The smaller the difference between the resonance frequency of the resonator and the operating frequency of the generator becomes, the higher the overvoltage coefficient of the resonator (the ratio between the amplitude of its output voltage and its input voltage) becomes.

Such a power supply circuit, detailed elsewhere in the patent application FR 03-10767, is diagrammatically represented in FIG. 2. It conventionally implements a "Class E power amplifier" assembly. This type of DC/AC converter makes it possible to create the voltage pulses with the above-mentioned characteristics.

According to the embodiment of FIG. 2, the amplifier 2 comprises a switch M for controlling the switching at the terminals of the resonator 1, implemented in this example in the form of a power MOSFET transistor.

Thus, a control device 5 generates and applies a control signal V1 at a control frequency to the gate of the power MOSFET M, via a control stage 3 which is diagrammatically represented. In order to control the production of sparks between the electrodes of the plug coil connected to the output of the amplifier when its resonator 1 is excited via the control signal V1, the latter is activated by the different ignition instructions and takes the form of control pulse trains at the control frequency.

As described in the patent application EP-A-1 515 594, a parallel resonant circuit 4 is connected between an intermediate voltage Vinter source and the drain of the transistor M. This circuit 4 comprises an inductance Lp in parallel with a capacitance Cp.

Close to its resonance frequency, the parallel resonator transforms the intermediate voltage Vinter into an amplified voltage Va (illustrated in FIG. 5), corresponding to the intermediate voltage multiplied by the overvoltage coefficient of the parallel resonator. This amplified voltage is supplied to the drain of the transistor M which is also linked to the input of the resonator 1.

The transistor M therefore acts as a switch and applies (respectively blocks) the voltage Va at the input of the resonator 1 when the control signal V1 is in the high (respectively low) logic state. The transistor M thus imposes a switching frequency, determined by the control signal V1, that should be made as close as possible to the resonance frequency of the plug coil connected to the output (typically 5 MHz), in order to maintain and maximize the transfer of energy between the parallel resonator 4 and the series resonator 1 forming the plug coil.

At the resonance frequency of the plug coil, there is then at the terminals of the capacitance C of the series resonator 1, or at the terminals of the electrodes of the plug, the output voltage Va mentioned previously, multiplied by the overvoltage coefficient of the series resonator 1.

This phase of energy transfer from the power stage formed by the amplifier to the resonator of the plug coil must be performed at the resonance frequency of the resonator, to ensure a good efficiency. In practice, if the transistor M imposes a switching frequency that is different from the resonance frequency of the plug coil, the energy transfer is degraded, because of the narrowness of the bandwidth of the series resonator used for the plug coil.

In an application with plasma generation motor vehicle ignition, each combustion chamber is equipped with a plug coil as described previously in order to initiate the combustion when ordered.

Consequently, for four-cylinder engines for example, it is essential to be able to have four power supply circuits of the class E amplifier type, as described previously with reference to FIG. 2, to power and respectively control the four plug coils.

Such a configuration, which therefore relies on as many amplification pathways as there are plug coils to be controlled, then limits the development potential of this type of motor vehicle ignition by plasma generation, on the one hand because of the bulk caused by this installation under the hood, but also because of the cost of installation, which can prove prohibitive to envisage installing this type of ignition on mass-produced vehicles.

The present invention aims to remedy this drawback, by making it possible to control a plurality of plug coils via one and the same, and a single, amplification pathway.

With this objective in mind, the subject of the invention is a radio frequency plasma generating device, characterized in that it comprises:

- a power supply circuit, comprising a switch controlled by a control signal for applying an intermediate voltage to an output of the power supply circuit at a frequency defined by the control signal,
- at least two plasma generation circuits connected in parallel to the output of the power supply circuit, each plasma generation circuit having its own resonance frequency and being capable of generating a plasma when a high voltage level is applied to the output of the power supply circuit at a frequency roughly equal to the resonance frequency of the plasma generation circuit,
- a device for controlling the power supply circuit, determining the frequency of the control signal from one of the resonance frequencies of the plasma generation circuits, so as to selectively control each plasma generation circuit according to the control frequency used.

According to an embodiment, each plasma generation circuit comprises a resonator, and each resonator has a distinct resonance frequency.

According to another embodiment, each plasma generation circuit comprises a resonator, each resonator having an identical resonance frequency, and at least one of the plasma generation circuits also comprises means of shifting the resonance frequency of its resonator.

Advantageously, the frequency-shifting means comprise an impedance matching circuit positioned in series between the output of the power supply circuit and the resonator.

Preferably, the impedance matching circuit comprises an inductance.

According to a variant, the impedance matching circuit comprises an impeding link cable providing the connection between the output of the power supply circuit and each resonator, the length of the portion of cable between the resonators defining the frequency shift between the resonators.

Advantageously, each plasma generation circuit is designed to produce an ignition in one of the following implementations: controlled ignition in a combustion engine cylinder, ignition in a particle filter, decontamination ignition in an air conditioning system.

The invention also relates to a method of controlling the power supply of a plasma generating device, comprising a power supply circuit having a switch controlled by a control signal for applying an intermediate voltage at a frequency defined by the control signal to an output of the power supply circuit, to which at least two plasma generation circuits are connected in parallel, each plasma generation circuit being designed to be selectively controlled at its own resonance frequency, said method comprising the steps of:

- reception of a request to determine a control frequency;
- determination of the plasma generation circuit to be controlled;
- determination of a control frequency that is roughly equal to the resonance frequency of the plasma generation circuit to be controlled;
- generation of the control signal at the determined control frequency.

Other characteristics and advantages of the present invention will become more clearly apparent on reading the following description, given by way of illustrative and nonlimiting example and with reference to the appended figures in which.

Figure 2:
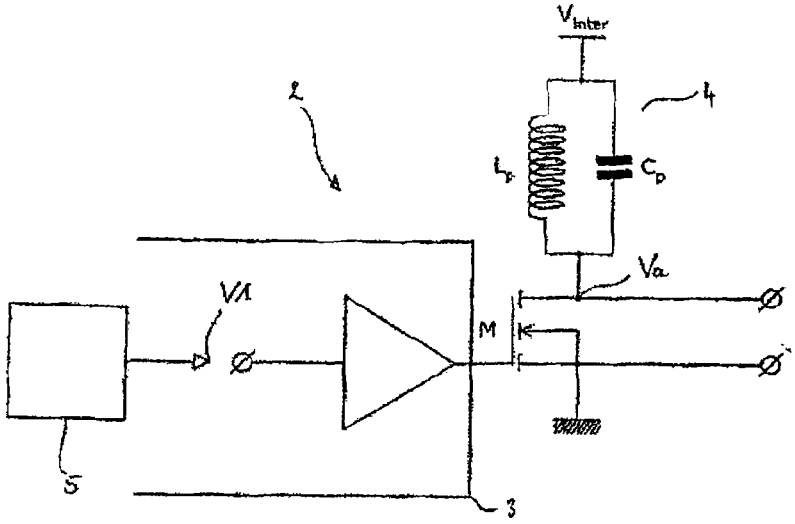
FIG. 2 BACKGROUND ART
FIG. 2 is a diagram illustrating a high-voltage generation device incorporating an amplifier, used for the power supply and the control of a plug coil.

The present invention therefore aims to control a plurality of plug coil-type plasma generation circuits, by using a single amplification pathway, in other words by using a single power supply circuit of the class E power amplifier type as described previously in FIG. 2, to selectively power the plurality of plasma generation circuits connected in parallel to the output of this single power supply circuit.

The principle on which this particular assembly is based consists in exploiting, at the high voltage and high frequency control level generated by the power supply circuit, the self-resonant frequency of each plasma generation circuit connected to the output of the power supply circuit.

In practice, it appears that a judicious distribution of the resonance frequencies of the plasma generation circuits makes it possible to naturally determine the desired transfer of power from the power supply circuit to one or other of the plasma generation circuits. Thus, one and the same high voltage, applied simultaneously at the output of the power supply circuit to the terminals of the plurality of plasma generation circuits that are connected thereto, makes it possible to selectively control one of these plasma generation circuits, depending on whether the control frequency used at the level of the power supply circuit is roughly aligned on the self-resonant frequency of the latter.

The condition for making it possible to independently control the plurality of plasma generation circuits via a single power supply circuit is therefore that each of these plasma generation circuits has a resonance frequency that is quite separate from the others. The object is, in effect, to avoid superimpositions of the resonance frequency domains of the resonators forming each plasma generation circuit and so eliminate the problems of multiple simultaneous ignitions.

The difference in resonance frequency between the multiple plasma generation circuits connected in parallel to the output of the single power supply circuit should preferably be at least equal to a multiple of the bandwidth of each resonator. It is possible, for example, to choose to shift the resonance frequency of each plasma generation circuit relative to the others by a value equal to two or three times the bandwidth of each circuit.

Several embodiments can be envisaged for producing such a frequency shift between the resonance frequencies of each plasma generation circuit.

A first method is to use, for each plasma generation circuit, a plug coil, as modeled in FIG. 1, different by construction, so that the plug coils employed have sufficiently distinct resonance frequencies in accordance with the principles set out hereinabove.

Figure 1:
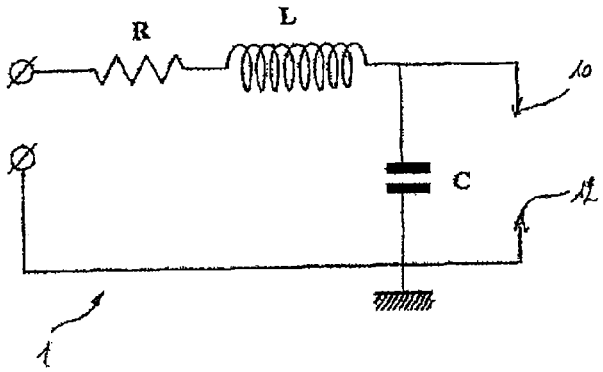
FIG. 1 BACKGROUND ART
FIG. 1 is a diagram illustrating an electrical model used for the resonator modeling a plasma generation plug coil.

This embodiment in which each plasma generation circuit comprises a resonator as represented in FIG. 1 and in which each resonator has a distinct resonance frequency, is not, however, optimal with a view to its integration in an industrial process.

In practice, it requires the industrial process to be adapted to the production of a plurality of distinct plug coils and then requires as many plug coil references as there are pathways to be controlled.

Figure 3:
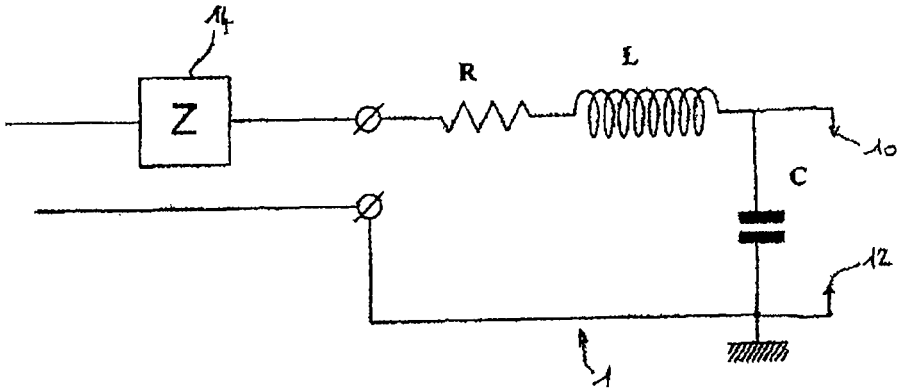
FIG. 3 illustrates a first embodiment of the distribution of the resonance frequencies of the plug coils according to the invention.
Figure 4:
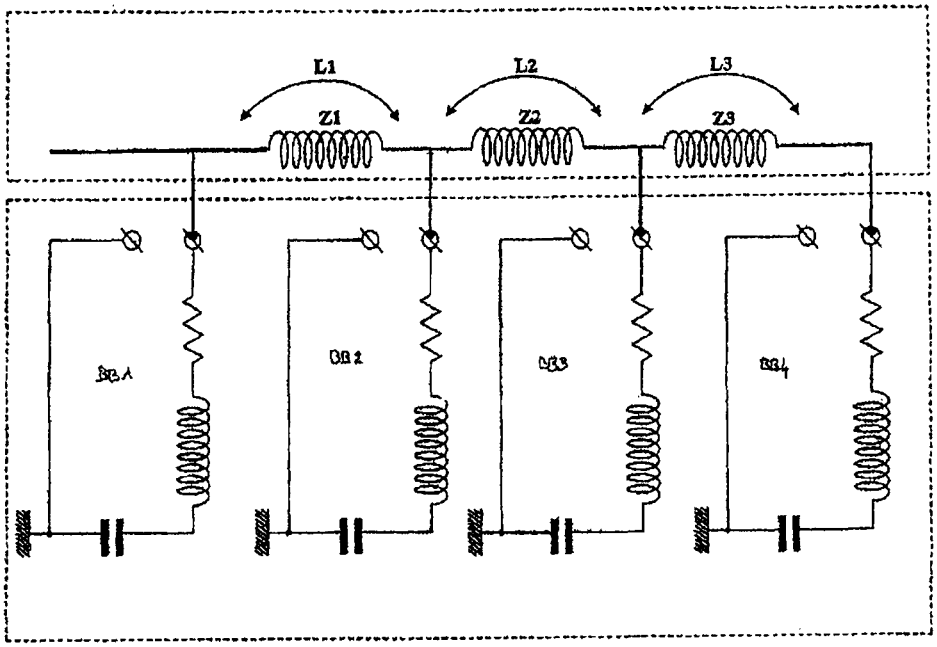
FIG. 4 illustrates a second embodiment of the distribution of the resonance frequencies of the plug coils according to the invention.

Also, with reference to FIGS. 3 and 4, a preferred embodiment for producing the shift in resonance frequency between the plurality of plasma generation circuits to be controlled consists in using identical plug coils, of which the resonators modeling them have identical resonance frequencies, and in associating with each resonator means of shifting its resonance frequency.

As illustrated in FIG. 3, the resonance frequency shifting means of a plasma generation circuit comprise an impedance matching circuit 14, designed to be positioned in series between the output of the power supply circuit 2 and the resonator 1. In this way, the pairing of impedance and resonator forming the plasma generation circuit has its resonance frequency shifted relative to the resonance frequency of the resonator 1 of the isolated plug coil.

Figure 5:
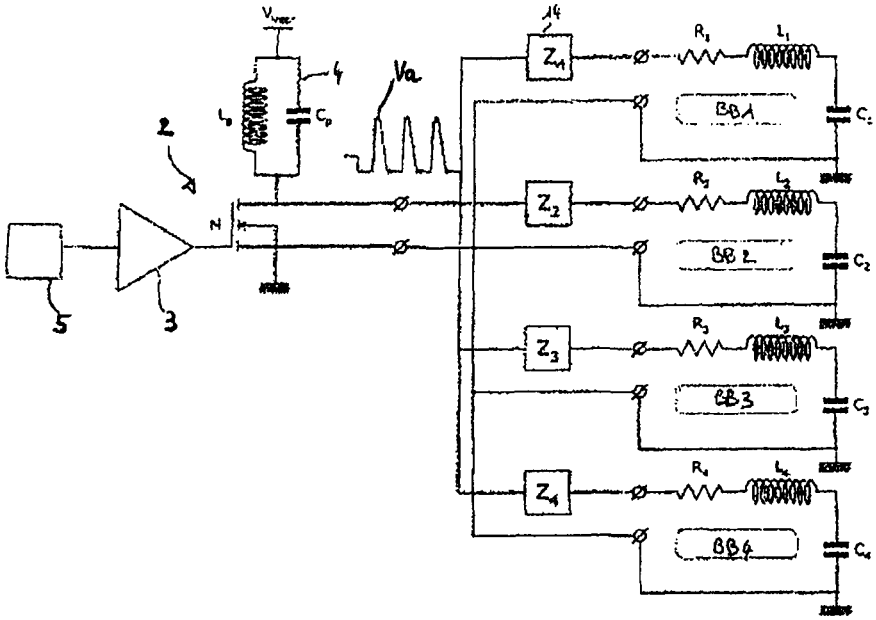
FIG. 5 illustrates a complete radio frequency ignition diagram comprising N plug coils according to the invention.

As illustrated in FIG. 5, the insertion of such impedance circuits, of different respective values, respectively Z1, Z2, Z3 and Z4, in series between the output of the single power supply circuit and each plug coil, respectively BB1, BB2, BB3 and BB4, then makes it possible to produce the desired distribution of the resonance frequencies of the plasma generation circuits connected in parallel to the output of the single power supply circuit, according to the principles explained above.

The impedance values of the circuits 14 are therefore chosen so that the difference in resonance frequency between each plasma generation circuit, each comprising an impedance-resonator pairing, is equal to at least a multiple of the bandwidth of each resonator.

It is possible to use, for example, for the added impedance circuits, inductances such that the resonance frequency of each plasma generation circuit is shifted by the desired value.

In the interests of optimizing the efficiency of the power supply circuit and optimizing the operation of the plug coils, it is possible to use identical plug coils whose resonance frequency is higher than the resonance frequency at which the plug coils are desired to be controlled. In this case, if the added impedance circuits are inductances, the effect of this addition should correspond to lowering the value of the overall resonance frequency of each inductance/plug coil pairing.

As a variant, it is possible to use, for one of the pathways to be controlled, a simple connection without the addition of any extra passive element, such as an inductance, in series with the plug coil.

According to another embodiment illustrated in FIG. 4, the means of shifting the resonance frequency of a plasma generation circuit relative to another, use the link cable providing the connection between the output of the power supply circuit and each plug coil as a series impedance, the plug coils also being identical, namely their resonators have an identical resonance frequency. In this case, it is the length of the cable portion, respectively L1, L2, L3, between the plug coils, respectively between BB1 and BB2, between BB2 and BB3 and between BB3 and BB4, which serves as an impedance, in particular an inductance, and so defines the resonator frequency shift between the resonators of the plug coils.

By using an impeding cable between the plug coils, it advantageously becomes possible to do away with the use of extra components for shifting the frequency of the plug coils, as required by the embodiment of FIG. 3.

Since the resonance frequencies of the different pathways are distributed independently according to the principles explained previously, the control method based on a single power supply circuit must then take account of the frequency matched to the pathway to be controlled for each ignition.

For this, according to an embodiment, the control device 5 of the power supply circuit can have a memory capable of retaining the order of classification of the frequencies corresponding to each of the pathways to be controlled.

Figure 6:
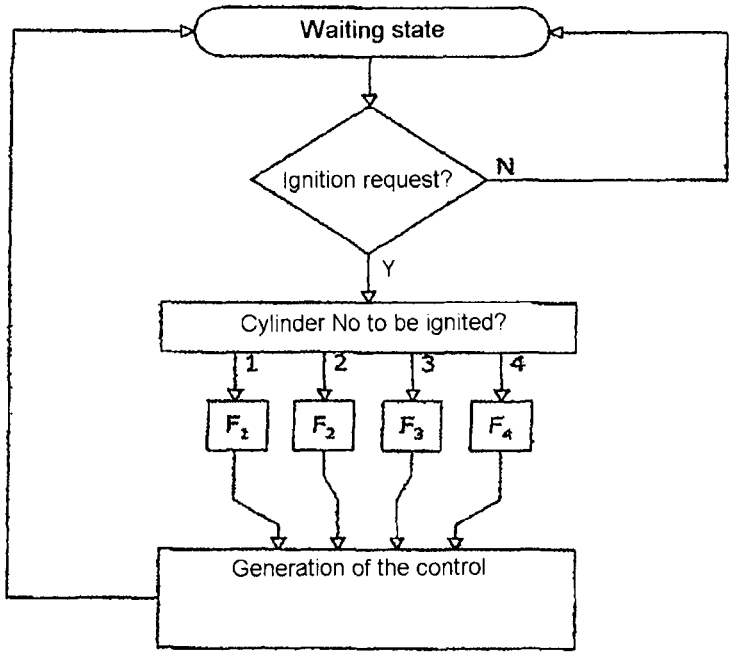
FIG. 6 is a flow diagram of an exemplary implementation of the control of the ignition according to the invention.

Thus, according to the example of FIG. 6 serving as a reference for a motor vehicle ignition application for a four-cylinder combustion engine, on reception of an ignition request, the control device is first able to determine the cylinder to be controlled, numbered from 1 to 4 for example in the order of arrangement on the engine. Each cylinder number therefore has associated with it the resonance frequency, respectively F1, F2, F3 and F4, that is specific to the corresponding plasma generation circuit that has to be controlled.

The control device then comprises a module determining the frequency of the control signal to be generated, from these frequencies F1, F2, F3 and F4, according to the cylinder number to be ignited and the order of classification of the frequencies stored previously.

Once the control frequency is determined, the control device applies the control signal at said frequency to an output interface, intended to control the switch M.

The selective transfer of power to the plasma generation circuit to be controlled for the ignition is then naturally managed by the control frequency used for this ignition.

According to a particular embodiment, the determination of the resonance frequencies to be obtained at the output of the single power supply circuit can be controlled by tabulation or servo-control methods as described in the French patent applications filed in the name of the applicant, FR 05-127669 and FR 05-12770.

For example, the control device can be provided with an interface for receiving engine operating parameter measurement signals (engine oil temperature, engine torque, engine speed, ignition angle, intake air temperature, pressure in the combustion chamber, etc.) and/or power supply operating parameter measurement signals, and a particular memory module memorizing the relationships between the measurement signals and the frequency of a control signal to be generated. The control device then determines the frequency of a control signal to be generated according to measurement signals received on the reception interface and the relationships memorized in the memory module.

Applications other than the implementation of a controlled combustion engine ignition can be envisaged without in any way departing from the framework of the present invention, such as the production of an ignition in a particle filter, or a decontamination ignition in an air conditioning system.

The invention claimed is:

1. A radio frequency plasma generating device, comprising:

a power supply circuit having a switch configured to be controlled by a control signal to apply an amplified voltage to an output of the power supply circuit selectively at each of a plurality of frequencies responsive to the control signal;

at least two plasma generation circuits connected in parallel to the output of the power supply circuit, each said plasma generation circuit including a resonator having a first resonance frequency and a bandwidth and being configured to generate plasma responsive to application of the amplified voltage to the output of the power supply circuit at a corresponding one of the plurality of frequencies;

a frequency-shifter, different from the plasma generation circuits, including at least one inductor connected between the power supply circuit and at least a first one of the plasma generation circuits; and a device configured to control the power supply circuit and to control the frequency of the control signal to output each one of the plurality of frequencies to the plasma generation circuits to selectively control each plasma generation circuit according to the control frequency used, wherein the plasma generation circuits are identical in configuration, the first resonance frequencies of the resonators being the same, and the bandwidth of the resonators being the same, wherein the frequency shifter is connected to said first plasma generation circuit such that a second resonance frequency, less than the first resonance frequency, is the corresponding one of the plurality of frequencies of the amplified voltage applied to the output of the power supply circuit to cause plasma generation by said first plasma generation circuit, and wherein each said frequency of the amplified voltage applied to the output of the power supply circuit is separated from all other of said output frequencies by an amount at least equal to a non-zero integer multiple of the bandwidth of the resonators.

2. The device as claimed in claim 1, wherein the frequency shifter is an impeding link cable providing respective connections between the output of the power supply circuit and all of the plasma generation circuits, a length of a portion of cable between respective adjacent plasma generation circuits creating respective second resonance frequencies to cause the plasma generation circuits to generate plasma.

3. The device as claimed in claim 1, wherein the plasma generation circuits produce ignition in one of the following implementations: controlled ignition in a combustion engine cylinder, ignition in a particle filter, or decontamination ignition in an air conditioning system.

4. The device as claimed in claim 1, wherein each said frequency of the amplified voltage applied to the output of the power supply circuit is separated from all other of said output frequencies by a value two or three times the bandwidth of the resonators.

5. The device as claimed in claim 1, wherein the frequency shifter is not connected to one of the plasma generation circuits, and said one plasma generation circuit is directly connected to the output of the power supply circuit.

6. The device as claimed in claim 1, wherein the frequency shifter includes a plurality of inductors of different values, the frequency shifter is connected between the power supply circuit and all of the plasma generation circuits, a total number of the plurality of inductors being the same as a total number of plasma generation circuits, and the inductors being connected in series between corresponding plasma generation circuits and the power supply circuit.

7. The device as claimed in claim 1, wherein the frequency shifter is an impeding link cable including a plurality of inductors, a total number of inductors of the impeding link cable being one less than a total number of plasma generation circuits.

8. The device as claimed in claim 1, wherein the frequency-shifter includes an impedance matching circuit, which includes the at least one inductor, in series between the output of the power supply circuit and said first plasma generation circuit.

9. The device as claimed in claim 8, wherein the impedance matching circuit is connected to a positive terminal of said first plasma generation circuit.

10. A method implemented by a radio frequency plasma generating device, the method comprising:

applying, via a switch controlled by a control signal, an amplified voltage to an output of a power supply circuit selectively at each of a plurality of frequencies responsive to the control signal;

generating, via at least two plasma generation circuits connected in parallel to the output of the power supply circuit and each including a resonator having a first resonance frequency and a bandwidth, plasma responsive to application of the amplified voltage the output of the power supply circuit at a corresponding one of the plurality of frequencies; and controlling the power supply circuit and determining the frequency of the control signal to output each one of the plurality of frequencies to the plasma generation circuits to selectively control each plasma generation circuit according to the control frequency used, wherein the plasma generation circuits are identical in configuration, the first resonance frequencies of the resonators being the same, and the bandwidth of the resonators being the same, wherein a frequency shifter including at least one inductor and different from the plasma generation circuits is connected between the power supply circuit and at least a first one of the plasma generation circuits such that a second resonance frequency, less than the first resonance frequency, is the corresponding one of the plurality of frequencies of the amplified voltage applied to the output of the power supply circuit to cause plasma generation by said first plasma generation circuit, and wherein each said frequency of the amplified voltage applied to the output of the power supply circuit is separated from all other of said output frequencies by an amount at least equal to a non-zero integer multiple of the bandwidth of the resonators.

* * * * *